United States Patent [19]

Akao et al.

[11] Patent Number: 4,800,034

[45] Date of Patent: Jan. 24, 1989

[54] COLD ROLLING OIL COMPOSITION FOR ALUMINUM AND ALUMINUM-CONTAINING ALLOYS

[75] Inventors: Masaru Akao, Utsunomiya; Yoshio Okamoto, Mouka; Akio Manba; Takehiko Ichimoto, both of Wakayama, all of Japan

[73] Assignee: Kao Corporation, Tokyo, Japan

[21] Appl. No.: 14,592

[22] Filed: Feb. 13, 1987

[30] Foreign Application Priority Data

Feb. 19, 1986 [JP] Japan ..... 61-34124

[51] Int. Cl.[4] ..... C10M 105/12; C10M 105/24

[52] U.S. Cl. ..... 252/56 S; 252/49.5; 252/50; 252/51.5 R; 252/52 A; 252/56 R

[58] Field of Search ..... 252/56 S, 49.5, 56 R

[56] References Cited

U.S. PATENT DOCUMENTS

| | | | |
|---|---|---|---|
| 3,945,930 | 3/1976 | Sugiyama et al. | 252/32.5 |
| 4,036,769 | 7/1977 | Zipf | 252/48.6 |
| 4,062,784 | 12/1977 | Baur | 252/495 |
| 4,096,078 | 6/1978 | Gaffe | 252/46.7 |
| 4,178,260 | 12/1979 | Cook et al. | 252/49.8 |
| 4,191,658 | 3/1980 | Johnke | 252/32.5 |
| 4,191,801 | 3/1980 | Johnke | 252/56 D |
| 4,292,187 | 9/1981 | Hentschel et al. | 252/49.5 |
| 4,566,983 | 1/1986 | Hayashi | 252/56 R |
| 4,578,202 | 3/1986 | Urban et al. | 252/56 S |
| 4,585,564 | 4/1986 | Johmata et al. | 252/49.5 |

*Primary Examiner*—William R. Dixon, Jr.
*Assistant Examiner*—Ellen McAvoy
*Attorney, Agent, or Firm*—Oblon, Fisher, Spivak, McClelland & Maier

[57] ABSTRACT

A novel water dispersible cold rolling oil composition for aluminum and aluminum-containing alloys comprising (a) one or more lube oil components selected from mineral oils, higher fatty alcohols, higher fatty esters and higher fatty acids, and (b) a specific water soluble cationic or amphoteric polymer compound. The composition provides a cold rolling lubricant which possesses excellent cooling capability, rolling lubricity and circulation stability, and can be readily controlled in operation.

6 Claims, 1 Drawing Sheet

COLD ROLLING OIL COMPOSITION FOR ALUMINUM AND ALUMINUM-CONTAINING ALLOYS

BACKGROUND OF THE INVENTION (1) Field of the Invention

This invention relates to a novel water dispersible cold rolling oil composition for aluminum and aluminum-containing alloys (hereinafter referred to simply as "a cold rolling oil for aluminum") and, more particularly, to a cold rolling oil for aluminum comprising (a) lube oil components and (b) a water soluble cationic polymer compound or a water soluble amphoteric polymer compound.

(2) Description of the Prior Art

A thin plate of metal is conventionally produced by means of a hot or cold rolling operation, in which various lube oils are employed depending on the manner of the rolling operation and the kind of metal to be rolled.

The characteristics required for such rolling lube oils include; having an excellent rolling lubricity, being capable of removing the working heat, not generating stains during annealing due to oil residues on the surface of the metal sheet, an aqueous fluid of the lube oil being easily controlled, having an extended life of use, being economical, and not generating rust on the metal surface.

Taking the cold rolling operation of steel as an example, the lubrication is conventionally performed by a lube oil composition emulsified in water and containing, as a base oil, an animal or vegetable oil such as tallow oil and palm oil, or a mineral oil, and oiliness improvers such as a fatty acid and the like.

On the other hand, the cold rolling of aluminum and aluminum-containing alloys is lubricated by a lube oil composition as they are, without being emulsified in water, said lube oil components comprising a low viscosity mineral oil, as a base oil, and various oiliness improvers.

The reason for using mineral oil having a low viscosity is effecting the rolling operation in the lubricating boundary area where the roll and an aluminum sheet contact each other through some molecular layers of a boundary lubricant film, thereby providing the plate surface with a luster which is inherent to aluminum.

The above-mentioned rolling lube oil for aluminum, however, has a low boiling point and thus is readily inflammable, because a low viscosity mineral oil is composed of hydrocarbons having a smaller molecular weight. Therefore, the measure is taken to obtain a low viscosity mineral oil with a higher flash point and a narrower boiling range (the fractionation range) by removing lower boiling components. Nevertheless, the rolling operation using such mineral oil involves the risk of fire all the time.

Furthermore, a tendency in recent years of the cold rolling operation of aluminum and aluminum-containing alloys is to use a higher speed and a higher reduction which has made the use of the conventional low viscosity mineral oil significantly handicapped because of incapability of mineral oils of removing the working heat.

SUMMARY OF THE INVENTION

The present inventors have made extensive studies for the purpose of preparing a rolling oil composition for aluminum which is free from the danger of fire in the high speed and high reduction rolling operation and, at the same time, has aforementioned various characteristics required for a rolling lube oil. As a consequence, the inventors found that such purpose could be accomplished by dispersing lube oil components in water using a specific water soluble cationic polymer compound or water soluble amphoteric polymer compound. More specifically, it was discovered by the present inventors that one or more lube oil components selected from the group consisting of a mineral oil, a higher fatty alcohol, a higher fatty acid ester and a higher fatty acid, when dispersed in water by the use of a specific water soluble cationic polymer compound or water soluble amphoteric polymer compound, could provide a cold rolling lubricant which possesses excellent cooling capability, rolling lubricity and circulation stability, and can be readily controlled in operation. These preferable characteristics, the good lubricity and circulation stability, in particular, are provided by the protective colloidal action of the aforementioned polymer compound which is capable of dispersing the lube oil components in water as particles with a suitable size. This dispersion of the oil components is stably maintained over a long period of use during which the lubricant fluid is circulated.

Accordingly, the object of this invention is to provide a water dispersible cold rolling oil composition for aluminum and aluminum-containing alloys, comprising, as its essential components, (a) one or more lube oil components selected from the group consisting of a mineral oil, a higher fatty alcohol, a higher fatty acid ester and a higher fatty acid and (b) one or more dispersant components selected from the group consisting of a water soluble cationic polymer compound and a water soluble amphoteric polymer compound, both having at least 2 basic nitrogen atoms or cationic nitrogen atoms in its molecule and a molecular weight of 1,000 to 10,000,000.

BRIEF DESCRIPTION OF THE DRAWING

The sole FIGURE is a diagramatical view showing the rolling operation using the rolling oil composition of this invention. In the figure, the numerals indicate the following objects or devices employed in the mill:

1. a work roll
2. a tested metal sheet
3. a coolant tank
4. a coolant nozzle
5. an air nozzle
6. a load cell

DETAILED DESCRIPTION OF THE INVENTION AND PREFERRED EMBODIMENTS

Figure 1:
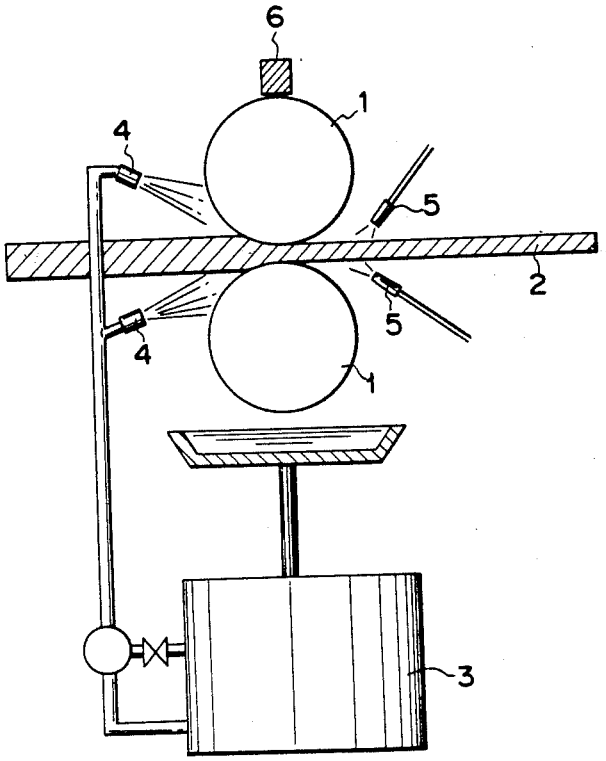

The lube oil components (a) used for the rolling oil composition of this invention may include; mineral oils such as spindle oil, machine oil, turbine oil, cylinder oil and polybutene; higher fatty alcohols having a linear or branched, saturated or unsaturated hydrocarbon group of 8 to 22 carbon atoms; higher fatty acids having a linear or branched, saturated or unsaturated hydrocarbon group of 8 to 22 carbon atoms; and esters of said higher fatty acids and mono- or polyhydric alcohols having 1 to 8 carbon atoms which may be either linear or branched. These oil components may be used either alone or combined with one or more other components(b). Particularly preferred lube oils are those containing, as essential components, both of a higher fatty alcohol and a higher fatty acid.

Described below are more specific examples of these lube oil components:

Higher Fatty Alcohol (i) Octyl alcohol, decyl alcohol, lauryl alcohol, myristyl alcohol, palmityl alcohol, stearyl alcohol, oleyl alcohol, behenyl alcohol, etc., which are obtained by hydrogenation of animal or vegetable oils and fats. In practice, Kalcohl 08, 10, 20, 40, 60, 80, 24, 42, 68, 86, 5–24, etc., manufactured by kao Corp. may be conveniently used.

(ii) Oxo alcohols which are produced by Oxo Process; i.e., by catalytic hydroformylation of olefins, which are produced by cracking of paraffins and waxes, using $CO/H_2$ gas under a high temperature and high pressure, followed by hydrogenation. In specific, these oxo alcohols include Dovanol 23, 45, etc., manufactured by Mitsubishi Petrochemical Co., Oxocol 911, 1213, 1215, 1415, etc., manufactured by Nissan Petrochemical Co., and Diadol 711, 911, 115, etc., manufactured by Mitsubishi Chemical Industries, Ltd.

(iii) Higher alcohols produced by Alfol Process; i.e., by reacting triethylaluminum (Ziegler Catalyst) and ethylene under a high temperature and high pressure to obtain a long chained trialkylaluminum, oxidizing the latter to form aluminum alcoxides, and then hydrolyzing the thus obtained aluminum alcoxides. The specific products include, for example, ALFOL 6, 8, 10, 12, 16, 18, 1012, 1014, 1214, 1216, 1218, 1416, etc., manufactured by Conoco Corp. and EPAL 610, 810, 108, 1214, 1416, 1418, etc., manufactured by Ethyl Corp.

(iv) Higher alcohols produced by dimerization of aldehyde by means of aldol condensation reaction, followed by hydrogenation. The specific examples of the products are 2-ethylhexanol and so called "Guerbet Alcohol" such as, for instance, Diadol 18G manufactured by Mitsubishi Chemical Industries, Ltd.

Higher Fatty Acid (i) Caproic acid, caprylic acid, lauric acid, myristic acid, palmitic acid, stearic acid, oleic acid, and behenic acid which are obtained by hydrolysis of animal or vegetable oils, and fats. Specific example of such acids are Lunac C-C, TS-2, TD-2, 8-98, 10-98, L-70, My-88, P-70, S-20, O-CA, O-LL, BA, etc., manufactured by Kao Corp.

(ii) Higher fatty acids produced by oxidizing alcohols which are prepared by dimerization of aldehyde by means of aldol condensation reaction and by hydrogenation. Specific products of this group include 2-ethylhexanoic acid, isostearic acid manufactured by Nissan Petrochemical Co. or Emery Corp., Guerbet fatty acid such as Diadol HA-18GA manufactured by Mitsubishi Chemical Industries, Ltd.

(iii) Polymerized acids produced from unsaturated monomer acids such as oleic acid by polymerization under heating in an autoclave, or by reacting monomer acids using a Lewis acid such as $BF_3$ as catalyst. These polymerized acids are usually available as a mixture of monomer, dimer and trimer. Depending on the ratio by weight of the monomer, dimer and trimer contained in the mixture, there are available various products, such as Empol 1010, 1022, 1024, 1040, etc., manufactured by Emery Corp. and Unidime 14, 18, 22, 24, 60, etc., manufactured by Union Camp. Corp., all of which are usable as a lube oil component in the present invention.

(iv) Alkenylsuccinic acids obtained by hydrolyzing alkenylsuccinic anhydrides which are produced by the addition reaction of $\alpha$-olefins and maleic anhydride.

A preferred embodiment of the lube oil component (a) for the cold rolling oil for aluminum of this invention contains 10 to 60 wt% of one or more of the aforementioned higher fatty alcohols and 2 to 20 wt% of one or more of the aforementioned higher fatty acids, the ratio by weight of higher fatty alcohols/higher fatty acids being in the range of 0.5 to 30. A desired lubricating performance may not be obtained, if the content of either the higher fatty alcohol or higher fatty acid is less than the above range. On the other hand, incorporation of the either component in excess of the above preferred range does not give the added effect.

It is essential for the water soluble cationic polymer compound and the water soluble amphoteric polymer compound, which are the component (b) of the cold rolling oil of the present invention, to have basic nitrogen atoms or cationic nitrogen atoms in a molecule. In addition, they may contain such groups as a salt of carboxylic acid, salt of phosphate, amide, ester and the like. These polymers are described below in more detail:

(i) A homopolymer or copolymer of two or more nitrogen-containing monomers of the following formulae (I) through (V) or salts or quaternary ammonium salts thereof:

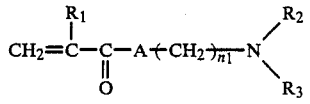

(I)

in which A represents —O— or —NH—, $n_1$ is a value of 1 to 3, and $R_1$ represents H or $CH_3$, and $R_2$ and $R_3$ independently represent H, $CH_3$ or $CH_2H_5$;

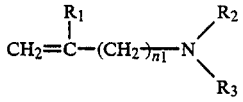

(II)

in which $R_1$, $R_2$, $R_3$ and $n_1$ have the same meaning as defined in the formula (I);

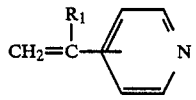

(III)

in which $R_1$ has the same meaning as defined in the formula (I) and pyridine is substituted at the 2 or 4 position;

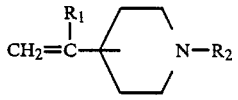

(IV)

in which $R_1$ and $R_2$ have the same meaning as defined in the formula (I) and piperidine is substituted at the 2 or 4 position; and

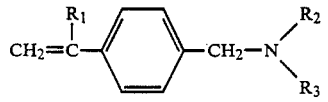

(V)

in which $R_1$, $R_2$, and $R_3$ have the same meaning as defined in the formula (I).

Enumerated as examples of the above monomers are; for the compound of the formula (I): dimethylaminoethylacrylate, diethylaminoethylacrylate, dimethylaminoethylmethacrylate, diethylaminoethylmethacrylate, dimethylaminopropylacrylamido, diethylaminopropylacrylamido, dimethylaminopropylmethacrylamido, diethylaminopropylmethacrylamido, etc.; for the compound of the formula (II): dimethylaminomethylethylene, diethylaminomethylethylene, dimethylaminomethylpropene, diethylaminomethylpropene, etc.; for the compound of the formula (III): vinylpyridine, etc.; for the compound of the formula (IV): vinylpiperidine, vinyl-N-methylpiperidine, etc.; and for the compound of the formula (V): vinylbenzylamine, vinyl-N,N-dimethylbenzylamine, etc.

Among homopolymers and copolymers as described above, those having a molecular weight of 1,000 to 10,000,000 are used as the component (b) of this invention.

(ii) Copolymers of one or more of the nitrogen-containing monomers of the formulae (I) through (V) above or salts or quarternary ammonium salts thereof and one or more of vinyl monomers selected from the group consisting of $\alpha,\beta$-unsaturated carboxylic acids or salts or derivatives thereof, sulfonic acid group-containing vinyl compounds or salts thereof, acrylonitrile, vinyl pyrrolidone, and aliphatic olefins having 2 to 20 carbon atoms.

Examples of the vinyl monomers include vinyl pyrrolidone; acrylonitrile; acrylic acid, methacrylic acid and maleic acid, and alkali salts, ammonium salts, amide compounds or esters of these acids; vinylsulfonic acid, methacrylsulfonic acid, 2-acrylamido-2-methylpropansulfonic acid and p-styrenesulfonic acid, and alkali salts or ammonium salts of these acids. Among these copolymers of nitrogen-containing monomers and vinyl monomers, those having an average molecular weight of 1,000 to 10,000,000 are employed in this invention.

(iii) Salts or quarternary ammonium salts of ring-opened polymers of ethyleneimine. Examples of the ring-opened polymers are those having a recurring unit represented by the formula (VI) and an average molecular weight of 1,000 to 10,000,000:

$$\left[(CH_2CH_2NH)_{n2}(CH_2CH_2\underset{\substack{|\\ CH_2CH_2NH_2}}{N})_{n3}\right] \quad \text{(VI)}$$

wherein $n_2$ is a value of 1 to 5 and $n_3$ is a value of 0 to 5.

(Iv) Salts or quarternary ammonium salts of polycondensates of aliphatic dicarboxylic acids and polyethylene-polyamines or dipolyoxyalkylenealkylamines. Examples of the polycondensates include those of aliphatic dicarboxylic acids and polyethylene-polyamines having a recurring unit represented by the formula (VII), or polyoxyalkylenealkylamines having a recurring unit represented by the formula (VIII), and having an average molecular weight of 1,000 to 10,000,000:

$$\left[OC-R_4-CONH(R'-NH)_{n4}-R'-NH\right] \quad \text{(VII)}$$

wherein $R_4$ represents a residual group of dimer acid or an alkyl group having 1 to 10 carbon atoms, R' represents $-CH_2CH_2-$, and $n_4$ is a value of 2 to 7;

$$\left[OC-R_4-CO(OCH_2\overset{R_6}{\overset{|}{C}}H)_{n5}-\overset{R_5}{\overset{|}{N}}(CH\overset{R_6}{\overset{|}{C}}H_2O)_{n6}\right] \quad \text{(VIII)}$$

wherein $R_4$ has the same meaning as defined in the formula (VII), $R_5$ represents an alkyl group having 1 to 8 carbon atoms, $R_6$ represents H or $-CH_3$, and $n_5$ and $n_6$ are independently a value of 1 to 10.

As examples of the aliphatic dicarboxylic acid, dimer acid, adipic acid and the like are given, while examples of polyethylene-polyamines include diethylenetriamine, triethylenetetramine, etc.

(v) Polymers having a recurring unit represented by the formula (IX) and an average molecular weight of 1,000 to 10,000,000:

$$\left(O-CH_2\underset{\substack{|\\ CH_2\\ |\\ N^{\oplus}(R_7)(R_8)(R_9)}}{CH}\right) X^{\ominus} \quad \text{(IX)}$$

wherein $R_7$, $R_8$, and $R_9$ represent independently $CH_3$ or $CH_2H_5$ and $X^{\ominus}$ represents halogen ion.

Among polymers as described in (i) through (v), particularly preferred are those having an average molecular weight of 10,000 to 1,000,000. A mixture of two or more of these water soluble cationic or amphoteric polymer compounds may be used. It is preferable to incorporate 0.1 to 10 wt% of these polymers in the cold rolling oil composition of this invention.

A quarternary ammonium salt as used in this specification means any compounds in which a nitrogen atom is cationized by covalently bonded 4 carbon atoms and which is further bonded by a counter anion to neutralize the cation. Such compound may be produced from either of the monomers of the formulae (I) through (VIII) above, for example, by quarternarizing the nitrogen atom of these monomers by an alkyl halide, by reacting an alkylene oxide following the neutralization of these monomers, or by alkylating these monomers using an alkylation agent such as dimethylsulfate. It must be noted that these nitrogen-containing monomers may be either polymerized after the nitrogen atom is cationized, or the monomer may be polymerized first and then the nitrogen atom cationized to obtain the polymer.

As examples of counter anions forming a salt or a quarternary ammonium salt of nitrogen-containing monomers which constitutes the water soluble cationic or amphoteric polymer compounds, enumerated are sulfate ion, nitrate ion, chloride ion, glycolate ion, acetate ion, phosphate ion, borate ion, etc. Among them, organic or inorganic phosphate ion having an acidic phosphate group therein and borate ion are preferred in view of the lubricity and rust inhibiting effects, which should by no means be construed to preclude the use of other anions.

Beside the essential components (a) and (b) as fully described in the foregoing, the cold rolling oil composition for aluminum of the present invention may be added with various known additives as desired, such as, for instance, an extreme-pressure agent, a rust inhibitor, an antioxidant, an emulsification adjuvant, and the like. These additives may be added in an amount depending on the requirement of each specific composition, but in the range of 0 to 5 wt% for the extreme-pressure agent, 0 to 2 wt% for the rust inhibitor, 0 to 5 wt% for the antioxidant, and 0 to 5 wt% for the emulsification adjuvant.

Phosphorous compounds such as tricresylphosphate and organometallic compounds such as zinc salt of dialkyl thiophophate are given as examples of the extreme-pressure agent. Examples of the rust inhibitor include alkenylsuccinic acids and derivatives thereof, esters such as sorbitanmonooleate, certain amines, and the like. The antioxidants include, for example, phenolic compounds such as 2,6-di-tert-butyl-p-cresol and aromatic amines such as phenyl-α-naphthylamine. The emulsification adjuvant used in the composition of the present invention may be, for example, nonionic surface active agents such as ethyleneoxide addition compounds of alkylphenols.

In the application to the rolling operation of aluminum and aluminum-containing alloys, the cold rolling oil composition of the present invention is used diluted by water. although there is no specific limitation to the degree of dilution, an aqueous fluid is usually composited by approximately 1 to 30 wt% of the inventive cold rolling oil composition and 99 to 70 wt% of water. Such an aqueous fluid is generally called "coolant", since it helps to cool down the temperature of the work roll and the material to be rolled. The temperature of the coolant is regulated between 40° C. and 70° C. during the operation, but it is essential that the temperature be higher than the melting point of the lube oil components contained in the composition.

The rolling operation of aluminum and aluminum-containing alloys using the inventive cold rolling oil composition may be conducted according to the following manner.

A quadruple rolling mill similar to the steel rolling mill equipped with a back-up roll is generally employed for rolling aluminum. The coolant is stored in an oil tank, from which it is pumped to the rolling mill and supplied on the rolled material, the work roll and the back-up roll through nozzles at the intake side of the rolls. A portion of the used coolant is recycled directly to the tank, while the remaining portion is sent to the filter to remove contaminants which are scraped or abraded from the metal surface, and then sent back to the tank. In the conventional rolling operaiton of aluminum in which the rolling oil is used neat, i.e., without being diluted by water, the filtration is effected by the use of a filtering medium such as diatomaceous earth. This material, however, swells up by water, and thus may not be usable for the filtration of the coolant which contains water. Therefore, the use of Hoffman fitler and the like, which is employed in the hot rolling of aluminum and the cold rolling of steel is suitable for the rolling operation using the inventive rolling oil composition.

In addition to the employment of such lube oil circulation system, the inventive cold rolling oil composition may be more effectively used by providing a squeeze roll at the exit of the mill and by injecting high pressure air on the work rolls and the squeeze roll at the exit side. This renders aforementioned several preferrable characteristics of the inventive rolling oil composition to be exhibited in an optimum mode. Furthermore, this arrangement makes it possible to completely remove the residual emulsion which is entangled and rolled up on the aluminum sheet during the operation, thereby preventing the finished metal sheet from getting rusted and contaminated while it is left over after the rolling operation.

The mechanism of the cold rolling oil composition for aluminum of the present invention is presumably considered as follows, although it is not completely elucidated. A water soluble cationic or amphoteric polymer compound, i.e., the component (b) of the inventive composition, which has been uniformly dissolved in water phase, adsorbs, prior to commencement of coalescence, particles of lube oils, i.e., the component (a), finely divided by the mechanical shearing force. The polymer compound serves to combine oil particles into larger-size particles by a kind of coagulation action. In addition, the polymer compound has such steric or electric action of protective colloid that the large-size particles can be stably dispersed in water, thereby rendering the component (a) to exhibit its effect of lubrication in an optimized condition.

Furthermore, in a preferred embodiment of the invention, a higher fatty acid, which is one of the essential ingredients of the component (a), is first adsobed on the surface of the aluminum sheet which is basic against acids and, upon the rolling of the metal sheet, outstanding rolling lubricity can be exhibited by the boundary lubricating effect between said higher fatty acid and a higher fatty alcohol which is the other essential ingredient of the inventive composition. In addition, a higher fatty acid adsorbed on the surface of the finished aluminum sheet serves as a thin protective film which prevents the aluminum surface from being rusted or corroded and keeps it clean.

The cold rolling lube oil composition of this invention prepared according to the method as fully described above possesses the following various advantages. First of all, the aqueous fluid lubricant containing the inventive composition, i.e., the coolant, exhibits a good cooling effect on the work roll. Viewing the inventive composition from the point of the coolant fluid control, the coolant has an outstanding circulation stability since the lube oil components is stably dispersed in water as particles with a suitable size which can be kept over a long period of use on account of the protective colloidal action of the water soluble cationic or amphoteric polymer compound. Furthermore, the coolant is free of producing a scum with a high apparent viscosity which contains as a major component metal particles or powders and metal soap yield by abrasion during the rolling operation, since surface of the metallic contaminants are rendered hydrophilic owing to the action of said water soluble cationic or amphoteric polymer compound and thus are stably dispersed in the continuous aqueous phase of the rolling oil. This prevents the metal surface from being damaged by the contaminants, reduces loss of lube oil components in the filtration stage, which, in turn, gives rise to reduction of the unit cost of the rolling operation and easy control of the coolant fluid.

Another outstanding feature of the inventive composition resides in the fact that the residual rolling oil dispersion on the strip surface can be easily removed from the metal sheet by means of air purge. This is the effect that no other known rolling oil emulsion prepared by the use of a conventional surface active agent possesses and can be provided only by using a water soluble cationic or amphoteric polymer compound which is the component (b) of the inventive composition. This effect also contributes to producing the finished aluminum sheet with a remarkably clean surface.

Moreover, according to the preferred embodiment of the invention, a higher fatty alcohol and a higher fatty acid of the composition gives a remarkably high lubricating performance owing to their boundary lubricating effect and, at the same time, the rolled material can be protected from the corrosive environment by the adsorptive action of the higher fatty acid against the basic aluminum surface.

The invention will be more specifically described by way of the following examples, which shall by no means be construed as limiting the scope of the invention.

In the examples below, either a water soluble cationic polymer compound or a water soluble amphoteric polymer compound is referred to as "Dispersant", and "wt %" is simply expressed by "%".

The inventive compositions Nos. 1–15 were prepared according to the method described above. Also prepared were the comparative compositions Nos. 1 and 2, which were the conventional "neat" (to be used without being diluted by water) aluminum rolling oil, and the comparative compositions Nos. 3 and 4, in which lube oil components were emulsified by the use of conventional surface active agents. All compositions, except for the comparative compositions Nos. 1 and 2, were dispersed by water of the amount of 9 times the lube oil components. The formulation of each of the compositions before being dispersed are given below.

| | |
|---|---|
| Inventive Composition No. 1 | |
| Mineral oil (15 cSt at 40° C.) | 77.0% |
| Butyl stearate | 20.0% |
| Dispersant (A) | 3.0% |
| (A): Copolymer of dimetylaminoethylmethacrylate neutralized by glycolic acid/sodium acrylate = 6/1 (M.W. = 500.000) | |
| Inventive Composition No. 2 | |
| Mineral oil (4.0 cSt at 40° C.) | 96.0% |
| Oleic acid (Lunac OP) | 2.0% |
| Antioxidant | 1.0% |
| Dispersant (B) | 1.0% |
| (B): Copolymer of dimetylaminoethylmethacrylate neutralized by gluconic acid/sodium 2-acrylamido-2-methylpropansulfonate = 4/1 (M.W. = 150.000) | |
| Inventive Composition No. 3 | |
| 2-ethylhexyl laurate | 46.0% |
| $C_{12}$–$C_{15}$ oxo alcohol (Oxocohol 1215) | 46.0% |
| Oleic acid (Lunac O-LL) | 4.0% |
| Phosphoric ester extreme pressure agent | 1.0% |
| Dispersant (C) | 3.0% |
| (C): Polycondensate of dimer acid and diethylenetriamine neutralized by phosphoric acid (M.W. = 100.000) | |
| Inventive Composition No. 4 | |
| Mineral oil ( 3.5 cSt at 40° C.) | 44.0% |
| Isopropyl myristate | 46.0% |
| Oleic acid (Lunac O-CA) | 4.0% |
| Phosphoric ester extreme pressure agent | 1.0% |
| Dispersant (A) | 2.0% |
| Dispersant (D) | 2.0% |
| (D): Polyethyleneimine neutralized by phosphoric acid (M.W. = 70.000) | |
| Inventive Composition No. 5 | |
| $C_{12}$–$C_{15}$ oxo alcohol (Oxocohol 1215) | 80.0% |
| Oleic acid (Lunac O-CA) | 10.0% |
| Dispersant (E) | 10.0% |
| (E): Copolymer of diethylaminoethylmethacrylate/vinylpyridine acetate/sodium methcrylate = 4/4/2 (M.W. = 150,000) | |
| Inventive Composition No. 6 | |
| Mineral oil (3.5 cSt at 40° C.) | 62.0 wt % |
| $C_{10}$–$C_{16}$ fatty alcohol (Kalcohl 5-42) | 30.0% |
| Tallow oil fatty acid | 5.0% |
| Dispersant (F) | 3.0% |
| (F): Ring-opened polymer of quarternary ammonium salt compound of epichlorohydrine and trimethylamine (M.W. = 3,500) | |
| Inventive Composition No. 7 | |
| Mineral oil (9.5 cSt at 40° C.) | 60.0% |
| Lauryl alcohol (Kalcohl 20) | 25.0% |
| $C_{18}$ Guerbet fatty acid (Daidol HA-18 GA) | 10.0 wt % |
| Dispersant (G) | 3.0% |
| (G): Copolymer of dimetylaminoethylmethacrylate/laurylmethacrylate = 3/1 (M.W. = 50.000) | |
| Inventive Composition No. 8 | |
| $C_{12}$–$C_{15}$ oxo alcohol (Oxocohol 1215) | 46.0% |
| Lauric acid (Lunac L-70) | 4.0% |
| n-butyl stearate | 46.0% |
| Dispersant (H) | 4.0% |
| (H): Homopolymer of quarternary ammonium salt of dimetyaminopropylmathacrylamido with methylchloride (M.W. = 800,000) | |
| Inventive Composition No. 9 | |
| Mineral oil (3.5 cSt at 40° C.) | 44.0% |
| $C_{18}$ Guerbet alcohol (Daidol 18G) | 10.0 wt % |
| Oleic acid (Lunac O-CA) | 4.0% |
| Isopropyl myristate | 35.0% |
| Dispersant (A) | 7.0% |
| Inventive Composition No. 10 | |
| $C_{12}$–$C_{15}$ oxo alcohol (Oxocohol 1215) | 80.0% |
| Palmitic acid (Lunac P-70) | 10.0% |
| Antioxidant | 1.0% |
| Dispersant (B) | 9.0% |
| Inventive Composition No. 11 | |
| Mineral oil (3.5 cSt at 40° C.) | 82.0 wt % |
| $C_{10}$–$C_{16}$ fatty alcohol (Kalcohl 5-42) | 5.0% |
| $C_{16}$, $C_{18}$ alkenylsuccinic acid | 5.0% |
| Dispersant (D) | 4.0% |
| Inventive Composition No. 12 | |
| Lauryl alcohol (Kalcohl 20) | 25.0% |
| $C_{18}$ Guerbet fatty acid (Daidol HA-18 GA) | 10.0% |
| Mineral oil (9.5 cSt at 40° C.) | 60.0% |
| Phosphoric ester extreme pressure agent | 1.0% |
| Dispersant (C) | 4.0% |
| Inventive Composition No. 13 | |
| Oleyl alcohol | 20.0% |
| Iso-stearic acid | 15.0% |
| Methyl ester of tallow fatty acid | 62.0% |
| Phosphoric ester extreme pressure agent | 1.0% |
| Dispersant (E) | 2.0% |
| Inventive Composition No. 14 | |
| $C_{12}$–$C_{15}$ oxo alcohol (Oxocol 1215) | 30.0% |
| Oleic acid (Lunac O-LL) | 10.0% |
| 2-ethylhexyl stearate | 15.0% |
| Mineral oil (9.5 cSt at 40° C.) | 40.0% |
| Dispersant (A) | 2.5% |
| Dispersant (D) | 2.5% |
| Inventive Composition No. 15 | |
| Lauryl alcohol (Kalcohl 20) | 55.0% |
| Dimer acid (Unidime 22) | 5.0% |

-continued

| | |
|---|---|
| Mineral oil (3.5 cSt at 40° C.) | 35.0% |
| Phosphoric ester extreme pressure agent | 1.0% |
| Dispersant (G) | 4.0% |
| Comparative Composition No. 1 | |
| Mineral oil (3.5 cSt at 40° C.) | 95.0% |
| Lauryl alcohol (Kalcohl 20) | 5.0% |
| Comparative Composition No. 2 | |
| Mineral oil (9.5 cSt at 40° C.) | 60.0% |
| $C_{12}$–$C_{15}$ oxo alcohol | 20.0% |
| Butyl stearate | 20.0% |
| Comparative Composition No. 3 | |
| Mineral oil (3.5 cSt at 40° C.) | 50.0% |
| Lauryl alcohol (Kalcohl 20) | 45.0% |
| Polyoxyethylenenonyl-phenylether (HLB = 12.4) | 5.0% |
| Comparative Composition No. 4 | |
| Mineral oil (9.5 cSt at 40° C.) | 52.0% |
| 2-ethylhexyl stearate | 35.0% |
| Myristic acid (Kalcohl M-70) | 10.0% |
| Polyoxyethylenenonyl-phenylether (HLB = 9.2) | 2.0% |
| Polyoxyethylenenonyl-phenylether (HLB = 13.7) | 1.0% |

The rolling test, air purge test, filtration test and rust formation test were carried out according to the procedures described below.

1. Rolling Test

The test was carried out using a rolling mill on the Inventive Compositions Nos. 1 to 15 and the Comparative Compositions Nos. 1 to 4. In the test the distance between rolls was decreased by a predetermined length at each rolling pass, and the rolling load and the rolling reduction were measured on each pass. The gross rolling load per unit width at a rolling reduction rate of 40% and 70% was determined from the gross rolling load—gross rolling reduction chart.

The following conditions were applied in this test.

| | |
|---|---|
| Specification of the rolling mill | |
| Diameter of the work roll | 200 mm |
| Width of the work roll | 200 mm |
| Material of the roll | SUJ-2 Hs 95 |
| Rolling speed | 100 m/min |
| Rolled material | |
| Pure aluminum plate | A1050 H |
| Width of the plate | 80 mm |
| Thickness of the plate | 3 mm |
| Length | 300 mm |

Rolling Oil

Rolling oils shown in Table 1 below were sprayed at a rate of 600 ml/min.

TABLE 1

| Rolling Oil | Applied Form | Temperature |
|---|---|---|
| Inventive Compositions Nos. 1–15 | 10% dispersion | 50° C. |
| Comparative Compositions Nos. 3 and 4 | 10% dispersion | 50° C. |
| Comparative Compositions Nos. 1 and 2 | Neat | room temp. |

2. Air purge test

The Inventive Compositions Nos. 1–15 and the Comparative Compositions Nos. 3 and 4 in 10% dispersion were sprayed on an aluminum plate of 60 mm×80 mm and then the surface of the plate were air purged using an EDM dryer (Product of Wingo Seiki), upon which removal condition of oils was observed.

3. Filtration test

Small fragments or powders of aluminum yielded Falex abrasion tester were added to each of one litter rolling oil compositions of Table 1 in such an amount as to bring the concentration of aluminum powder to 100 ppm. Each of thus obtained mixtures was filtered using Hoffman filter paper (#650). This procedure was repeated 30 times on each of the compositions, whereupon residual oils and aluminum powders collected on the paper were weighed to determine "concentration degree", as hereinafter defined, of aluminum powders by filtration.

4. Rust formation test

A finished aluminum sheet was cut to make 100 mm×50 mm plates. Ten (10) of these plates were piled one over the other and put into a thermostat dryer where they were left over for 15 hours. Then, formation of rust on the aluminum plates was observed.

Results of the above rolling test, air purge test and rust formation test are shown in Table 2 and those of filtration test in Table 3 below.

TABLE 2

| | Gross rolling load per unit width (kg/mm) | | | |
|---|---|---|---|---|
| | Gross rolling reduction at 40% | Gross rolling reduction at 70% | Formation of rust | Residues after air purge |
| Inventive Composition | | | | |
| No. 1 | 209 | 430 | Non | Non |
| No. 2 | 210 | 438 | Non | Non |
| No. 3 | 206 | 421 | Non | Non |
| No. 4 | 198 | 401 | Non | Non |
| No. 5 | 195 | 390 | Non | Non |
| No. 6 | 207 | 425 | Non | Non |
| No. 7 | 197 | 398 | Non | Non |
| No. 8 | 202 | 410 | Non | Non |
| No. 9 | 198 | 401 | Non | Non |
| No. 10 | 196 | 392 | Non | Non |
| No. 11 | 203 | 417 | Non | Non |
| No. 12 | 197 | 398 | Non | Non |
| No. 13 | 196 | 395 | Non | Non |
| No. 14 | 195 | 390 | Non | Non |
| No. 15 | 201 | 408 | Non | Non |
| Comparative Composition | | | | |
| No. 1 | 263 | 680 | Non | — |
| No. 2 | 250 | 636 | Non | — |
| No. 3 | 212 | 450 | formed | residues on edges |
| No. 4 | 220 | 461 | formed | residues on edges |

TABLE 3

| | Composition before filtration test | | | Composition of materials collected by filtration | | | |
|---|---|---|---|---|---|---|---|
| | Oils (%) | Al. (%) | Oil/Al | Oils (%) | Al. (%) | Oil/Al | C.D. (Note 1) |
| Inventive Composition | | | | | | | |
| No. 8 | 10.0 | 0.01 | 1000 | 10.5 | 0.033 | 323 | 3.1 |
| No. 9 | 10.0 | 0.01 | 1000 | 10.2 | 0.030 | 345 | 2.9 |
| No. 10 | 10.0 | 0.01 | 1000 | 10.3 | 0.033 | 313 | 3.2 |
| No. 11 | 10.0 | 0.01 | 1000 | 10.2 | 0.031 | 333 | 3.0 |
| No. 12 | 10.0 | 0.01 | 1000 | 10.2 | 0.031 | 333 | 3.0 |
| No. 13 | 10.0 | 0.01 | 1000 | 10.1 | 0.029 | 345 | 2.9 |
| No. 14 | 10.0 | 0.01 | 1000 | 10.5 | 0.033 | 323 | 3.1 |
| No. 15 | 10.0 | 0.01 | 1000 | 10.1 | 0.032 | 313 | 3.2 |
| Comparative Composition | | | | | | | |
| No. 1 | 10.0 | 0.01 | 1000 | 100 | 0.018 | 5556 | 1.8 |
| No. 2 | 10.0 | 0.01 | 1000 | 100 | 0.015 | 6667 | 1.5 |
| No. 3 | 10.0 | 0.01 | 1000 | 11.8 | 0.021 | 556 | 1.8 |

TABLE 3-continued

| | Composition before filtration test | | | Composition of materials collected by filtration | | | |
|---|---|---|---|---|---|---|---|
| | Oils (%) | Al. (%) | Oil/Al | Oils (%) | Al. (%) | Oil/Al | C.D. (Note 1) |
| No. 4 | 10.0 | 0.01 | 1000 | 12.0 | 0.026 | 455 | 2.2 |

Note 1:
"C.D." is defined as the concentration degree of aluminum as determined by the following equation:

$$C.D. = \frac{\text{Oil/Al before filtration test}}{\text{Oil/Al collected by filtration}}$$

What is claimed is:

1. A water dispersible cold rolling oil composition for aluminum and aluminum-containing alloys, consisting essentially of (a) as lube oil component a mixture of a higher fatty alcohol having 8 to 22 carbon atoms and a higher fatty acid having 8 to 22 carbon atoms and (b) 0.1 to 10 wt.% of one or more dispersant components selected from the group consisting of a water soluble cationic polymer compound and a water soluble amphoteric polymer compound, both having at least 2 basic nitrogen atoms or cationic nitrogen atoms in their molecule and a molecular weight of 1,000 to 10,000,000.

2. The water dispersible cold rolling oil composition for aluminum and aluminum-containing alloys as claimed in claim 1, wherein said water soluble cationic polymer compound or water soluble amphoteric polymer compound is an addition polymer, a ring-opened polymer or a polycondensate or a naturally occurring polymer which is either cationic or amphoteric and has nitrogen atoms in the molecule thereof.

3. The water dispersible cold rolling oil composition for aluminum and aluminum-containing alloys as claimed in claim 1, wherein said lube oil component consists essentially of 10–60 wt.% of said higher fatty alcohol and 2–20 wt.% of said higher fatty acid, and the ratio of said higher fatty alcohol/said higher fatty acid is in the range of 0.5–30.

4. The water dispersible cold rolling oil composition for aluminum and aluminum-containing alloys as claimed in claim 1, 2 or 3 wherein said higher fatty alcohol has a linear or branched, saturated or unsaturated hydrocarbon group having 8 to 22 carbon atoms and said higher fatty acid has a linear or branched, saturated or unsaturated hydrocarbon group having 8 to 22 carbon atoms.

5. The water dispersible cold rolling composition of claims 1, 2 or 3, wherein the dispersant is a water soluble cationic polymer compound.

6. The water dispersible cold rolling composition of claims 1, 2 or 3, wherein the dispersant is a water soluble amphoteric polymer compound.

* * * * *